US008616886B2

(12) United States Patent
Clark

(10) Patent No.: US 8,616,886 B2
(45) Date of Patent: Dec. 31, 2013

(54) DISPLAY FOR VIEWING COLORSWATCHES

(76) Inventor: Michael Clark, Wading River, NY (US)

( * ) Notice: Subject to any disclaimer, the term of this patent is extended or adjusted under 35 U.S.C. 154(b) by 180 days.

(21) Appl. No.: 13/187,974

(22) Filed: Jul. 21, 2011

(65) Prior Publication Data

US 2012/0329011 A1 Dec. 27, 2012

Related U.S. Application Data

(60) Provisional application No. 61/501,428, filed on Jun. 27, 2011.

(51) Int. Cl.
*G09B 19/10* (2006.01)

(52) U.S. Cl.
USPC ..... 434/100; 434/98; 434/99; 434/377

(58) Field of Classification Search
USPC ..... 434/100, 377, 98–10
See application file for complete search history.

(56) References Cited

U.S. PATENT DOCUMENTS 2,623,304 A * 12/1952 Watson ..... 434/100
6,598,608 B1 * 7/2003 Downey ..... 132/200

* cited by examiner

*Primary Examiner* — Benjamin Layno
(74) *Attorney, Agent, or Firm* — Lowenstein Sandler LLP

(57) ABSTRACT

Described herein is a color display for cosmetics. The color display has a partially transparent flap with color swatches placed thereon, which allows the user to view a color as it may appear on their body.

14 Claims, 5 Drawing Sheets

DISPLAY FOR VIEWING COLORSWATCHES

BACKGROUND

Cosmetics come in every color and shade imaginable, from bright blue nail polish to subtle pink lipstick. However, it is difficult to determine how a particular color will look on the wearer without actually testing out the cosmetic.

Testing the cosmetics is the best way to try out a new color, however, there are many retailers who do not allow consumers to test the products prior to purchase. This leaves the consumer with having to guess how the color might look on them.

Thus, there remains a need in the art to provide a way in which consumers can determine how a particular cosmetic color might look on them without having to purchase and/or use the cosmetic.

This need is met by the present invention which is directed to a color display having a partially transparent flap with color swatches placed thereon. When a person places the flap over their skin, fingernail, etc., they can view the color as it might appear on their body.

BRIEF SUMMARY OF THE INVENTION

The present invention is directed to apparatuses and methods for viewing color swatches over a user's skin.

In certain embodiments, the present invention is directed to an apparatus for viewing color swatches comprising an at least partially transparent flap and a color swatch.

In certain other embodiments, the present invention is directed to a display comprising a display backer; and at least one shelf having a bullnose housing an insert, the insert having an at least partially transparent flap with a color swatch.

In yet other embodiments, the present invention is directed to a method for manufacturing a color display comprising providing a flap that is at least partially transparent and placing a color swatch on the transparent portion of the flap.

In yet other embodiments, the present invention is directed to a method of displaying a color over a user's body comprising providing an apparatus for viewing color swatches, the apparatus having an at least partially transparent flap and a color swatch, wherein the user places at least a portion of their body under the flap and views the color swatch on their body through the flap.

As used herein, the term "transparent" is intended to mean having the property of transmitting light through its substance so that articles situated beyond or behind can be distinctly seen.

As used herein, the term "body" is meant to include any part of the human body, including, e.g., skin, fingers, fingernails, hair, lips, eyes, etc.

DETAILED DESCRIPTION

The color display of the present invention allows a user to place a part of their body under at least a portion of the display, and view the color is it would appear on their body. This is done by providing a flap having a transparent portion and a color swatch located on the flap. The color swatch is placed onto only a portion of the flap so that when the user places, e.g., a finger, under the flap (or places the flap over the finger, as the case may be) the user can view both a portion of their finger along with the color swatch, and then can determine how the color might look on their body.

Figure 1:
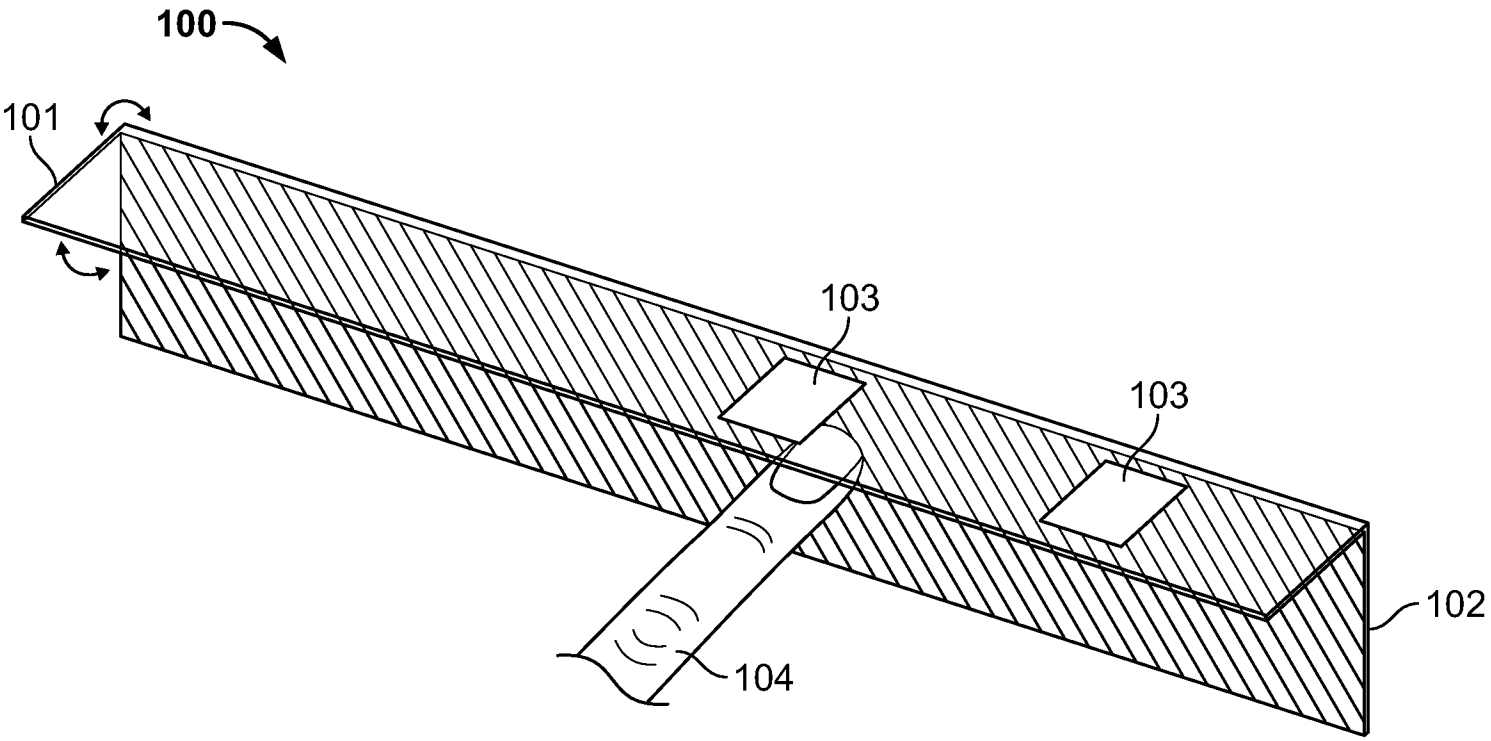
FIG. 1 depicts an embodiment of the color display of the present invention.

Referring now to FIG. 1, in certain embodiments, the color display 100 of the present invention comprises a flap 101 which is attached to a backing 102, the flap 101 being comprised at least partially of a transparent material. Color swatches 103 are located on the flap. The user places the flap over at least a portion of their body, e.g., their finger 104. This enables the user to view the color swatch on their body to give the user a sense of how the color may appear on their particular skin tone.

Figure 2A:
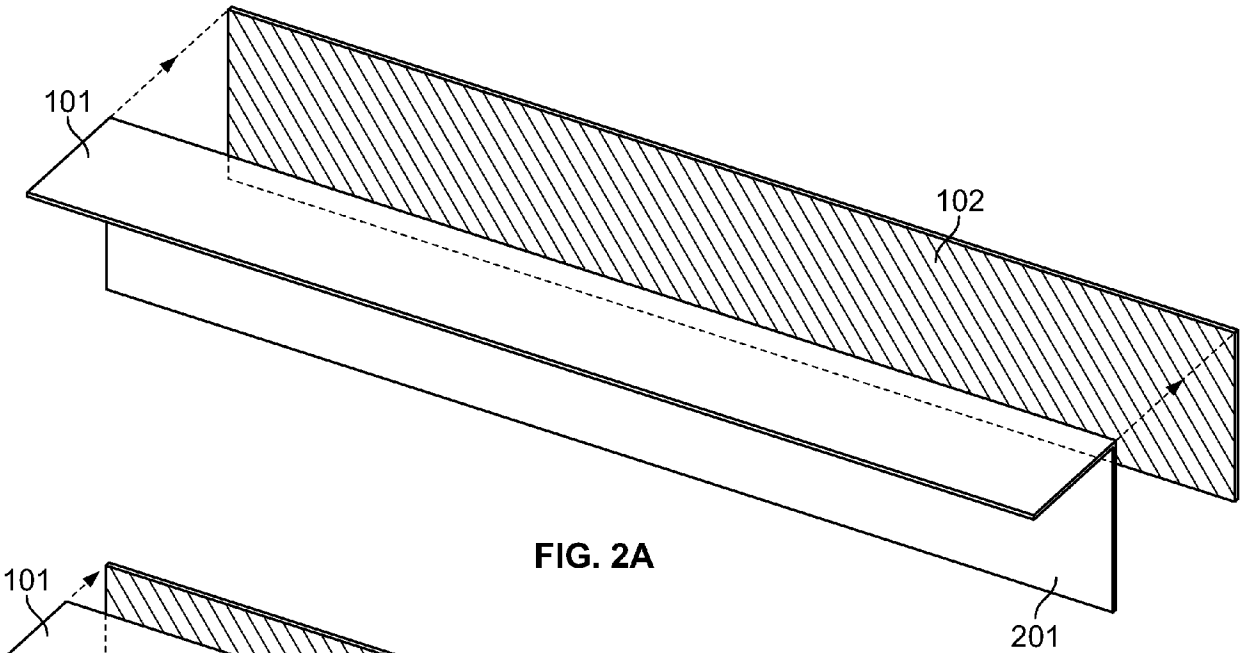
FIGS. 2A-2C depict various embodiments for attachment of the flap to the backing of the color display of the present invention.

In embodiments with a backing, the flap 101 of the color display is attached to the backing by any means known in the art. For example, the flap 101 can be attached as a continuous adhesive strip 201 which affixes to the front surface of the backing 102, as shown in FIG. 2A.

Figure 2B:
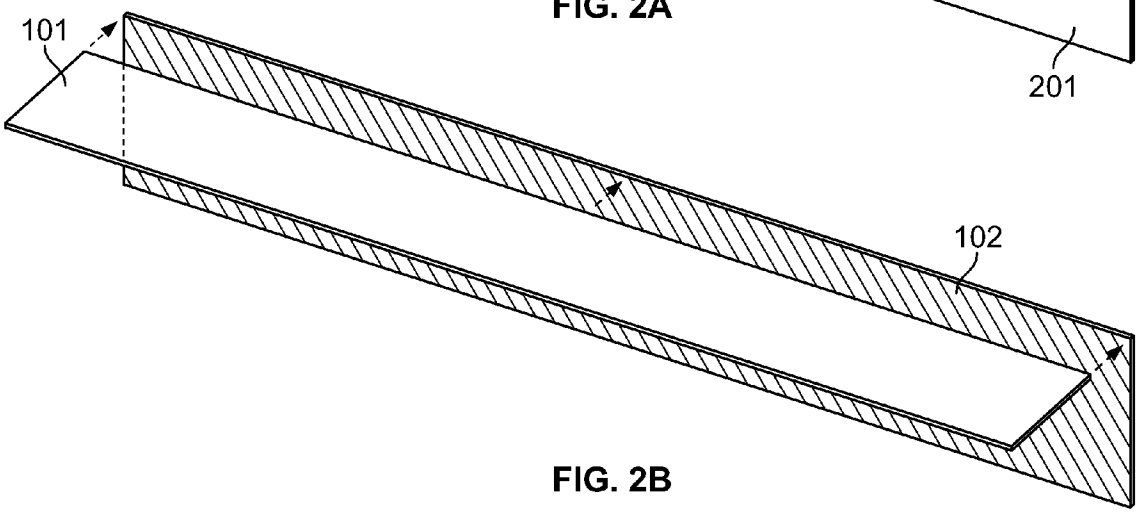

Alternatively, the flap 101 of the color display is attached directly to an end of the backing 102, as shown in FIG. 2B. Preferably, the flap 101 is attached to the top end of the backing 102 and pivots from a down position where it is in close contact with the front surface of the backing 102 to an up position away from the backing 102, so that a user can insert a portion of their body under the flap 101.

Figure 2C:
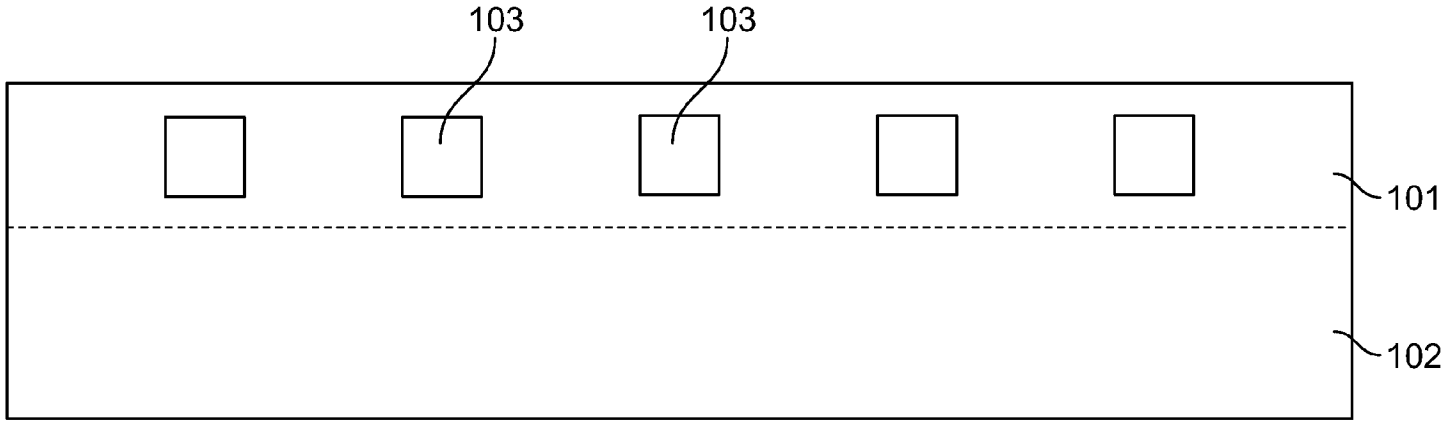

FIG. 2C depicts an alternate embodiment in which the transparent flap 101 and the backing 102 are a single unit. The hash marks depict where the transparent flap 101 would be folded. However, it is contemplated that the transparent flap does not fold and remains in a substantially flat position relative the backing.

Figure 2D:
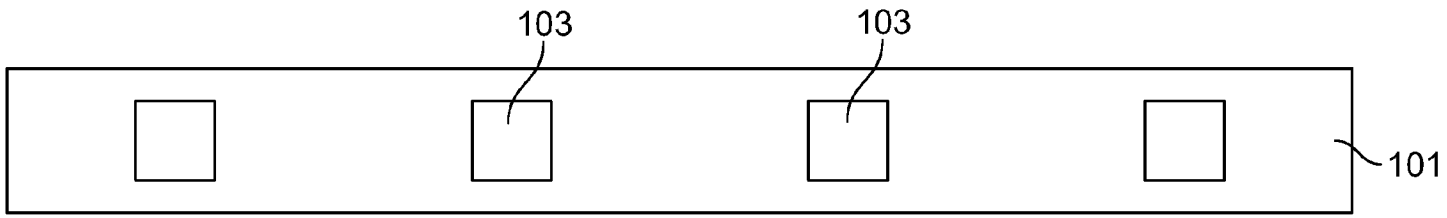
FIG. 2D depicts an embodiment of the present invention where only the flap is present in the color display.

FIG. 2D depicts an alternate embodiment in which the color display contains a flap 101 with no backing.

Figure 3:
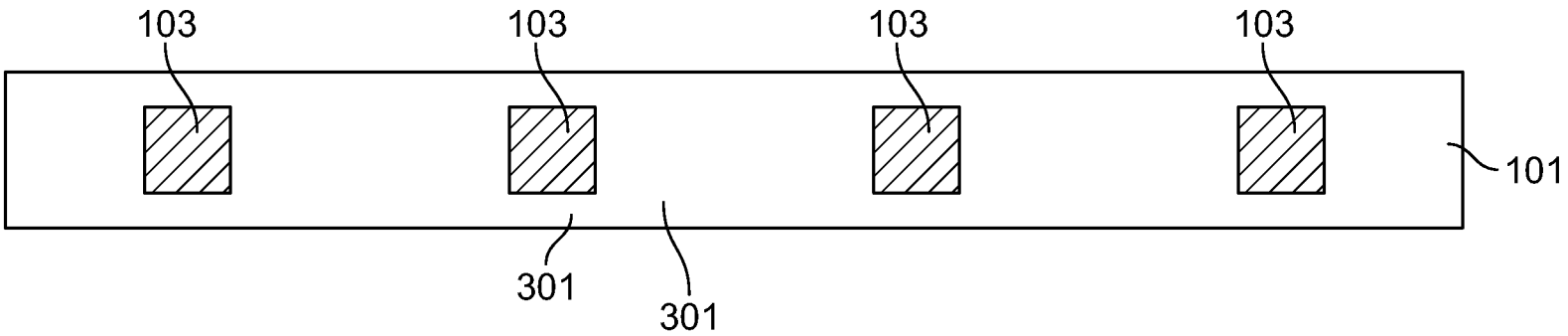
FIG. 3 depicts an embodiment of the flap used in the color display of the present invention.

Referring now to FIG. 3, the color swatches 103 are preferably positioned on the flap 101 such that at least a portion of the color swatch 103 is surrounded by transparent material 301. This allows the user to view both the color swatch and the portion of their body that is inserted under the flap.

The flap can be comprised of any transparent material, however plastic is the preferred material, as it is inexpensive to manufacture and durable. In certain embodiments, only a portion of the flap is transparent. In other embodiments, the entire flap is transparent with the exception of color swatches.

The backing may be comprised of any material suitable to maintain integrity, while still being flexible enough, e.g., to be inserted into a bullnose holder. Exemplary materials include, but are not limited to, cardboard, paperboard, plastic and other similar materials or combinations thereof.

Figure 4:
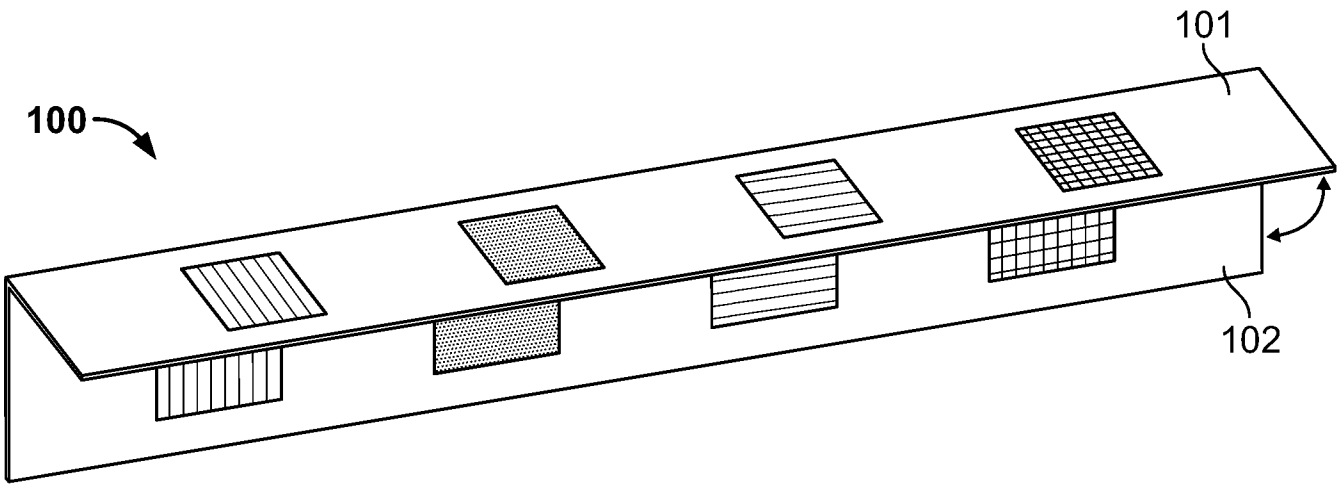
FIG. 4 depicts an embodiment of the flap used in the color display of the present invention.

In preferred embodiments, matching color swatches are provided on the backing of the apparatus, and are preferably positioned on the backing such that when the flap is positioned to be in close contact with the front surface of backing, the color swatches of the backing correspond with the color swatches of the flap, as shown in FIG. 4.

The color swatches on the flap and/or the backing may be printed directly thereon, or may be printed indirectly by being printed on a film layer which then overlays the flap and/or backing. It should be noted that the color swatches need not be any particular shape. For example, the color swatches may be round, oval, triangular, rectangular, diamond-shaped or cylindrical, etc.

In preferred embodiments, the backing also contains information printed therein relating to the product. For example, in addition to or in place of the color swatch on the backing, the backing can contain the color number or name associated with the color swatch.

The color display can be configured to fit it a bullnose holder of a shelf, attached directly to a display or used by itself.

The color display can be used to display the color of any product, but is preferably used to display the color of cosmetics. Examples of cosmetics include, but are not limited to, nail polish, foundation, lipstick, blush and eye shadow.

What is claimed:

1. An apparatus for viewing color swatches of a cosmetic comprising an at least partially transparent flap and a color swatch of a cosmetic and a backing having a front surface coupled to the flap, wherein the backing comprises a corresponding color swatch which corresponds to the color swatch on the flap.

2. The apparatus of claim 1, wherein the flap is coupled to the backing to pivot between a first position extending along the front surface of the backing and a second position extending away from the front surface of the backing.

3. The apparatus of claim 2, wherein the color swatch is positioned on the flap to at least partially cover the corresponding color swatch when the flap is in the first position.

4. The apparatus of claim 1, wherein the flap comprises multiple color swatches.

5. The apparatus of claim 1, wherein the entire flap is transparent.

6. The apparatus of claim 5, wherein the cosmetic is one of a nail polish, a foundation, a lipstick, a blush or an eye shadow.

7. The apparatus of claim 1, wherein the transparent portion of the flap surrounds at least a portion of the color swatch.

8. The apparatus of claim 1, wherein the color swatch is round, oval, triangular, rectangular, diamond-shaped or cylindrical.

9. A method for manufacturing a color display comprising providing an apparatus comprising an at least partially transparent flap and a backing having a front surface coupled to the flap; placing a color swatch on at least part of the transparent portion of the flap; and placing a corresponding color swatch on the backing which corresponds to the color swatch on the flap.

10. The method of claim 9, wherein the flap is attached to an adhesive film and the backing is coupled to the flap by attaching the adhesive film to a front surface of the backing.

11. The method of claim 9, wherein the flap is coupled to the backing by attaching a top end of the flap to a top end of the backing.

12. The method of claim 9, wherein the color swatch is placed directly onto the flap.

13. The method of claim 9, wherein the color swatch is placed indirectly onto the flap.

14. The method of claim 9, wherein the color swatch corresponds to a color of a cosmetic.

* * * * *